US006815134B2

(12) United States Patent
Kyung

(10) Patent No.: US 6,815,134 B2
(45) Date of Patent: Nov. 9, 2004

(54) PHOTOCONDUCTIVE DRUM IN AN IMAGE FORMING APPARATUS AND METHOD THEREOF

(75) Inventor: Myung-ho Kyung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 83 days.

(21) Appl. No.: 10/218,484

(22) Filed: Aug. 15, 2002

(65) Prior Publication Data

US 2003/0148200 A1 Aug. 7, 2003

(30) Foreign Application Priority Data

Feb. 4, 2002 (KR) ..... 2002-6305

(51) Int. Cl.[7] ..... G03G 5/14

(52) U.S. Cl. ..... 430/60; 430/62; 430/63; 399/159

(58) Field of Search ..... 430/60, 62, 63, 430/69, 131; 399/159, 116

(56) References Cited

U.S. PATENT DOCUMENTS 5,828,931 A * 10/1998 May et al. ..... 430/57.1
6,004,669 A * 12/1999 Rokutan et al. ..... 428/335
6,366,750 B1 * 4/2002 Swain ..... 399/116
6,541,171 B1 * 4/2003 Chowdry et al. ..... 430/58.65

* cited by examiner

*Primary Examiner*—John L Goodrow
(74) *Attorney, Agent, or Firm*—Staas & Halsey LLP

(57) ABSTRACT

A photoconductive drum forming an image by using an electric potential characteristic of a surface thereof includes a cylindrical base body, a photosensitive layer formed on the cylindrical base body to be chargeable with electricity, and an elastic layer having a hardness of below 70 degrees by the Asker "C" scale and formed in a thickness greater than 10 $\mu$m between the cylindrical base body and the photosensitive layer. The photoconductive drum is implemented in an image forming apparatus and absorbs shocks generated when the photoconductive drum contacts a development roller, a charging roller, and a transfer roller and impacts caused by the development roller when developing devices are exchanged or replaced, to protect the cylindrical base body and the photosensitive layer thereon, thereby. A stable image quality is maintained, and a life span of the photoconductive drum is extended, even though the charging roller or the transfer roller as well as the development roller is made of a rigid body.

47 Claims, 3 Drawing Sheets

PHOTOCONDUCTIVE DRUM IN AN IMAGE FORMING APPARATUS AND METHOD THEREOF

CROSS-REFERENCE TO RELATED APPLICATIONS

This application claims the benefit of Korean Patent Application No. 2002-6305, filed Feb. 4, 2002, in the Korean Industrial Property Office, the disclosure of which is incorporated herein by reference.

BACKGROUND OF THE INVENTION

1. Field of the Invention

The present invention relates to a photoconductive drum in an image forming apparatus, which is adapted for use in an office machine, such as a color copier, color printer and the like, having a plurality of developing devices using electrophotography, and more particularly, to a photoconductive drum in an image forming apparatus and a method of forming the same, the photoconductive drum having an elastic layer formed between a cylindrical base body of the photoconductive drum and a photosensitive layer thereon to protect the cylindrical base body and the photosensitive layer, thereby to maintain a stable image quality and extend a life span of the photoconductive drum.

2. Description of the Related Art

Generally, an electrophotographic image forming apparatus used in an office machine, such as a color copier, color printer and the like, is provided with an organic photoconductive or photosensitive drum 11 which is rotated in one direction by a drum-driving source (not shown), as shown in FIG. 1. Around a circumferential surface of the photoconductive drum 11, a first charging device 12, a laser scanning unit (LSU) 20, four developing devices 31, 32, 33, 34 containing developers of yellow, magenta, cyan, and black, respectively, an image-transferring part 60, an optical discharging or quenching lamp 87, and a cleaning-discharging part 80 are disposed in respective given positions along the rotating direction of the photoconductive drum 11.

The first charging device 12, such as a cyclotron-charging device, electrifies the photoconductive drum 11, and the LSU 20 photo-exposes the photoconductive drum 11 in line shapes along an axial direction thereof through a light source, such as a semiconductor laser source.

Each of the developing devices 31, 32, 33, 34 includes a development roller 13, a developer reservoir 16, a developer-supplying roller 15, a developer layer-regulating member 51 regulating a thickness of a developer layer which is attached on the development roller 13, and a regulating roller 61, 62, 63, or 64 concentrically disposed on both ends of the development roller 13. The components of each developing device 31, 32, 33, or 34 are driven to be rotated by a developing device-driving source (not shown). The developer is supplied to the development roller 13 through the developer-supplying roller 15, and at the development roller 13, regulated in a thin film by the developer layer-regulating member 51. The regulating roller 61, 62, 63, or 64 is disposed to be in contact with the photoconductive drum 11 and to protrude slightly from an outer surface of a developer layer of the development roller 13 such that in a developing process, a given space is formed between the development roller 13 and the photoconductive drum 11.

Also, each of the developing devices 31, 32, 33, 34 is supported to be reciprocally movable by a member (not shown) guiding the developing devices 31, 32, 33, 34. The developing devices 31, 32, 33, 34 are moved toward the photoconductive drum 11 against corresponding releasing springs 74 when eccentric cams 35, 36, 37, 38 rotatably fixed on shafts 56 rotate to push corresponding developing devices 31, 32, 33, 34 toward the photoconductive drum 11. The rotation of shafts 56 is controlled by electronic clutches (not shown). Also, in the developing process, a bias voltage is supplied to the development roller 13. When a negative-positive reversal process is performed in the development roller 13, the bias voltage has the same polarity as the outer surface of the photoconductive drum 11.

The image-transferring part 60 electrostatically transfers a colored visual image formed on the photoconductive drum 11 onto a sheet of printing paper, and the cleaning-discharging part 80 removes the developers remaining on the photoconductive drum 11.

An operation of the image forming apparatus 10 will now be explained.

First, when a printing command is issued, a photoconductive drum 11 is continuously rotated by the drum-driving source, and at the same time, a surface of the photoconductive drum 11 is uniformly electrified by the first charging device 12. When an electrified region (surface) of the photoconductive drum 11 reaches a color developing position, for example, a yellow developing position "d" of a yellow developing device 31, an electronic clutch of the yellow developing device 31 is operated to rotate the eccentric cam 36 to move the yellow developing device 31 toward the photoconductive drum 11 in a yellow developing state.

The surface of the photoconductive drum 11 is photo-exposed by the LSU 20 to form an electrostatic latent image of yellow. When the surface of the photoconductive drum 11 is positioned at the yellow developing position "d" according to the rotation of the photoconductive drum 11, the electrostatic latent image of yellow is developed from a front end to a rear end thereof to form a continuous yellow image.

After the continuous yellow image is formed and the rear end of thereof is passed through the yellow developing position "d", the eccentric cam 35 is rotated to separate the yellow developing device 31 from the photoconductive drum 11.

After that, when the front end of the yellow image reaches another color position, for example, a magenta developing position "e" of the magenta developing device 32, an electronic clutch of the magenta developing device 32 is operated to rotate the eccentric cam 36 to move the magenta developing device 32 toward the photoconductive drum 11 in a magenta developing state.

At this time, the yellow image formed on the photoconductive drum 11 is passed by the image-transferring part 60, the quenching lamp 87, and the cleaning-discharging part 80 which are in a non-operating state, and then the front end of the photoconductive drum 11 is disposed again below the first charging device 12. Particularly, the image-transferring part 60 and the cleaning-discharging part 80 are maintained in a non-contact state with the photoconductive drum 11 except in a printing operation so that the yellow image to be passed do not come to be dim or muddy. Below the first charging device 12, the photoconductive drum 11 on which the yellow image is formed is again uniformly electrified and then photo-exposed by the LSU 20 to form an electrostatic latent image of magenta overlappingly on the yellow image.

As the overlappingly formed electrostatic latent image of magenta is positioned at the magenta developing position "e" according to the rotation of the photoconductive drum 11, it is developed into a continuous yellow•magenta-overlapped image. After the yellow•magenta-overlapped image is formed and a rear end thereof is passed through the magenta developing position "e", the eccentric cam 36 is rotated and thereby the magenta developing device 32 is separated from the photoconductive drum 11.

Thereafter, when the front end of the yellow•magenta-overlapped image reaches another color position, for example, a cyan developing position "f" of cyan developing device 33, an electronic clutch of the cyan developing device 33 is operated to rotate the eccentric cam 37 to move the cyan developing device 33 toward the photoconductive drum 11 in a cyan developing state.

At this time, the yellow•magenta-overlapped image formed on the photoconductive drum 11 is positioned again below the first charging device 12 after passing by the image-transferring part 60, the quenching lamp 87, and the cleaning-discharging part 80 which are in the non-operating state. Below the first charging device 12, the photoconductive drum 11 on which the yellow•magenta-overlapped image is formed is again uniformly electrified and then photo-exposed by the LSU 20 to form an electrostatic latent image of cyan overlappingly on the yellow•magenta-overlapped image. And, at the cyan developing position "f", the overlappingly formed electronstatic latent image is developed into a continuous yellow•magenta•cyan-overlapped image. After the yellow•magenta•cyan-overlapped image is formed and the rear end of thereof is passed through the cyan developing position "f", the eccentric cam 37 is rotated to separate the magenta developing device 33 from the photoconductive drum 11.

Next, an electrostatic latent image of black is overlappingly formed and then developed in the same manner as described above, and thereby the entire operation of forming a colored visual image on the photoconductive drum 11 is completed.

Thereafter, the resultant visual image formed on the photoconductive drum 11 is transferred on a sheet of printing paper P fed from a paper-supplying part by the image-transferring part 60.

After transferring, the photoconductive drum 11 is discharged by the quenching lamp 87 and returned to the first state by removing the developers remaining on the surface of the photoconductive drum 11 by a cleaning rotation brush 81 of the cleaning-discharging part 80.

At this time, the printing paper P on which the resultant visual image is transferred is transported to a fusing part to fix the transferred image thereon through a hot roller and then discharged to the outside.

Thus, the conventional image forming apparatus 10 has a structure that the development rollers 13 of four developing devices 31, 32, 33, 34 are operated to come in contact with the photoconductive drum 11 with corresponding developers disposed therebetween to develop corresponding electrostatic latent images. Accordingly, to form the colored visual image, the photoconductive drum 11 performs the developing process once each color, i.e., total 4 times. At this time, the development rollers 13 of the developing device 31, 32, 33, 34 are contacted at a given pressure with or separated from the photoconductive drum 11 by the eccentric cams 35, 36, 37, 38, respectively, so that each of them can be maintained in a development position or a stand-by position.

However, the photoconductive drum 11 is generally formed of a cylindrical member of metal such as aluminum having a high hardness on which a photosensitive layer and the like are coated. Also, the development rollers 13 are formed of cylindrical members of aluminum or a resin having the high hardness. Therefore, contact shocks generated when the photoconductive drum 11 is rotated and comes in contact with the development rollers 13 of the developing devices 31, 32, 33, 34 to perform each developing process are transmitted directly to the entire structure of the photoconductive drum 11, thereby resulting in a non-stabilized image quality developed on the photoconductive drum 11.

Also, impacts caused by changes in pressure generating when the respective development rollers 13 of the developing devices 31, 32, 33, 34 are moved to be in contact with or separated from the photoconductive drum 11 to perform the developing process for each color or to change or replace the developing device 31, 32, 33, or 34, are transmitted directly on the photoconductive drum 11 performing other processes, for example, a charging or photo-exposure process to impair the photosensitive layer of the photosensitive drum 11. As a result, the image quality developed on the photoconductive drum 11 deteriorates or the life span of the photoconductive drum 11 is reduced.

Also, in another conventional image forming apparatus using a contact type charging roller or a contact type transfer roller made of a rigid body, the contact shocks generated when the photoconductive drum is rotated and comes in contact with the contact type charging roller or the contact type transfer roller to perform the charging or transferring process, are transmitted directly on the photoconductive drum. As a result, the image quality developed on or transferred by the photoconductive drum is destabilized.

SUMMARY OF THE INVENTION

Therefore, it is an object of the present invention to provide an improved photoconductive drum and image forming apparatus using the same, which has an elastic layer formed between a cylindrical base body of the photoconductive drum and a photosensitive layer thereon to absorb shocks generating when the photoconductive drum comes in contact with a development roller of a high hardness and impacts caused by the development roller when developing devices are exchanged or replaced, thereby protecting the cylindrical base body and the photosensitive layer to maintain a stable image quality and to extend a life span of the photoconductive drum.

It is another object to provide an improved photoconductive drum and image forming apparatus using the same, which can absorb shocks generating when the photoconductive drum comes in contact with a development roller, a charging roller, and a transfer roller, and impacts caused by the development roller when developing devices are exchanged and replaced, to protect a photosensitive layer of the photoconductive drum, thereby to maintain a stable image quality and to extend a life span, even though the charging roller or the transfer roller as well as the development roller is formed of a rigid body.

Additional objects and advantages of the invention will be set forth in part in the description which follows and, in part, will be obvious from the description, or may be learned by practice of the invention.

These and other objects may be achieved, according to an embodiment of the present invention, by providing a photoconductive drum forming an image by using an electric potential characteristic of a surface thereof. The photoconductive drum includes a cylindrical member, a photosensitive layer formed on the cylindrical member to be chargeable with electricity, and an elastic layer formed in a thickness greater than 10 μm between the cylindrical member and the photosensitive layer.

A hardness of the elastic layer measured by the Asker "C" scale is below 70 degrees.

The cylindrical member is made of a conductive material of one of a metal, such as copper, aluminum, gold, argentum, platinum, palladium, iron, nickel, stainless steel and the like, and an alloy containing the metal as a major ingredient. The cylindrical member may have a film made of one of aluminum, aluminum-contained alloy, and indium tin oxide (ITO)-contained alloy and formed on the conductive material by a vacuum plating or evaporation (sputtering) method.

Alternatively, the cylindrical member can be formed of a plastic material impregnated by fine conductive particles together with plastic having a predetermined binder or a conductive binder. In this case, the plastic material is made of thermo-plastic resin of at least one selected from a group consisting of polycarbonate resin, acryl resin, styrene resin, polyolefin resin, fluoric resin, polyester resin, polyphenylene-sulfide resin, polyphthalamide resin, and liquid crystal polymer; a conductive agent controlling an electric resistance and made of a conductive material of at least one selected from a group consisting of carbon black, tin oxide, titanium oxide, and argentum; and a dispersing agent made of an inorganic material, such as calcium carbonate and clay, to uniformly disperse the conductive agent.

The elastic layer is made of a material of at least one selected from a group consisting of elastomers such as butyl rubber, fluoric rubber, acryl rubber, ethylene-propylene-diene-methylene (EPDM) rubber, acrylonitrile-butadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, polysulfide rubber, polynorbornene rubber, hydrogenated nitrile rubber and the like; and thermoplastic elastomers such as polystyrene elastomer, polyolefin elastomer, polyvinyl chloride elastomer, polyurethane elastomer, polyamide elastomer, polyurea elastomer, polyester resin, fluoric resin and the like.

Alternatively, in a case that the cylindrical member is made of one of the metal and the metal-contained alloy, the elastic layer can be formed of material of at least one selected from a group consisting of polycarbonate resin; a fluoric resin such as ethylene-tetrafluoroethylene (ETFE) and polyvinylidene fluoride (PVDF); styrene resin (homopolymer or copolymer containing styrene or styrene substituent) such as polystyrene, polychlorostyrene, poly-α-methylstyrene, styrene-butadiene copolymer, styrene-vinyl chloride copolymer, styrene-vinyl acetate copolymer, styrene-maleic acid copolymer, styrene-acrylate copolymer, styrene-ester methacrylate copolymer, styrene-methyl α-chloroacrylate copolymer, and styrene-acrylonitrile-acrylate copolymer; methyl methacrylate resin; butyl methacrylate resin; ethyl acrylate resin; butyl acrylate resin; modified acrylic resin; vinyl chloride resin; vinyl chloride-vinyl acetate copolymer; rosin modified maleic resin; phenolic resin; epoxy resin; polyester resin; polyester-polyurethane resin; polyethylene; polypropylene; polybutadiene; polyvinylidene chloride; ionomer resin; polyurethane resin; silicone resin; ketone resin; ethylene-ethyl acrylate copolymer; xylene resin; polyvinyl butyral resin; polyamide resin; and modified polyphenylene oxide resin. Also, the elastic layer can be formed of a foam material.

Also, the elastic layer may include a conductive agent to ensure an electric charge on a surface thereof to be smoothly discharged when the photoconductive drum is electrically grounded. The conductive agent can use one among an electrically conductive material made of at least one selected from a group consisting of carbon black, graphite, metal powder such as aluminum and nickel, conductive metal oxide such as tin oxide, titanium oxide, antimony oxide, indium oxide, potassium titanate, antimony tin oxide (ATO), and ITO. The conductive agent may include corpuscles of insulating fine particles made of a material such as barium sulfate, magnesium silicate and calcium carbonate and coated on the electrically conductive material.

The photoconductive drum includes an adhering layer formed between the elastic layer and the photosensitive layer. The adhering layer includes a white pigment and a resin material as a chief ingredient. In this case, the white pigment is made of metal oxide of at least one of titanium oxide, aluminum oxide, zirconium oxide, zinc oxide and the like, and the resin material is made of at least one selected from a group consisting of thermoplastic resin such as ethyl cellulose, polyurethane resin, polyamide resin, polyvinyl alcohol resin, casein, and methyl cellulose; and thermosetting resin such as acrylic resin, phenolic resin, melamine resin, alkyd resin, unsaturated polyester resin and epoxy resin.

According to an aspect of the present invention, there is provided an image forming apparatus including a photoconductive drum forming an image by using an electric potential characteristic of a surface thereof, a charging roller having a rigid body and electrifying the photoconductive drum while pressure-contacting the photoconductive drum, and an image forming part forming a visual image on the photoconductive drum while pressure-contacting the photoconductive drum, and having at least a development roller formed of the rigid body. The photoconductive drum includes a cylindrical member, a photosensitive layer formed on the cylindrical member to be chargeable with electricity, and an elastic layer formed with a thickness greater than 10 μm between the cylindrical member and the photosensitive layer.

In another embodiment of the present invention, a hardness of the elastic layer measured by the Asker "C" scale is below 70 degrees.

Also, the image forming apparatus may include an image-transferring part transferring the visual image from the photoconductive drum while pressure-contacting the photoconductive drum, and having at least a transfer roller formed of a rigid body

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
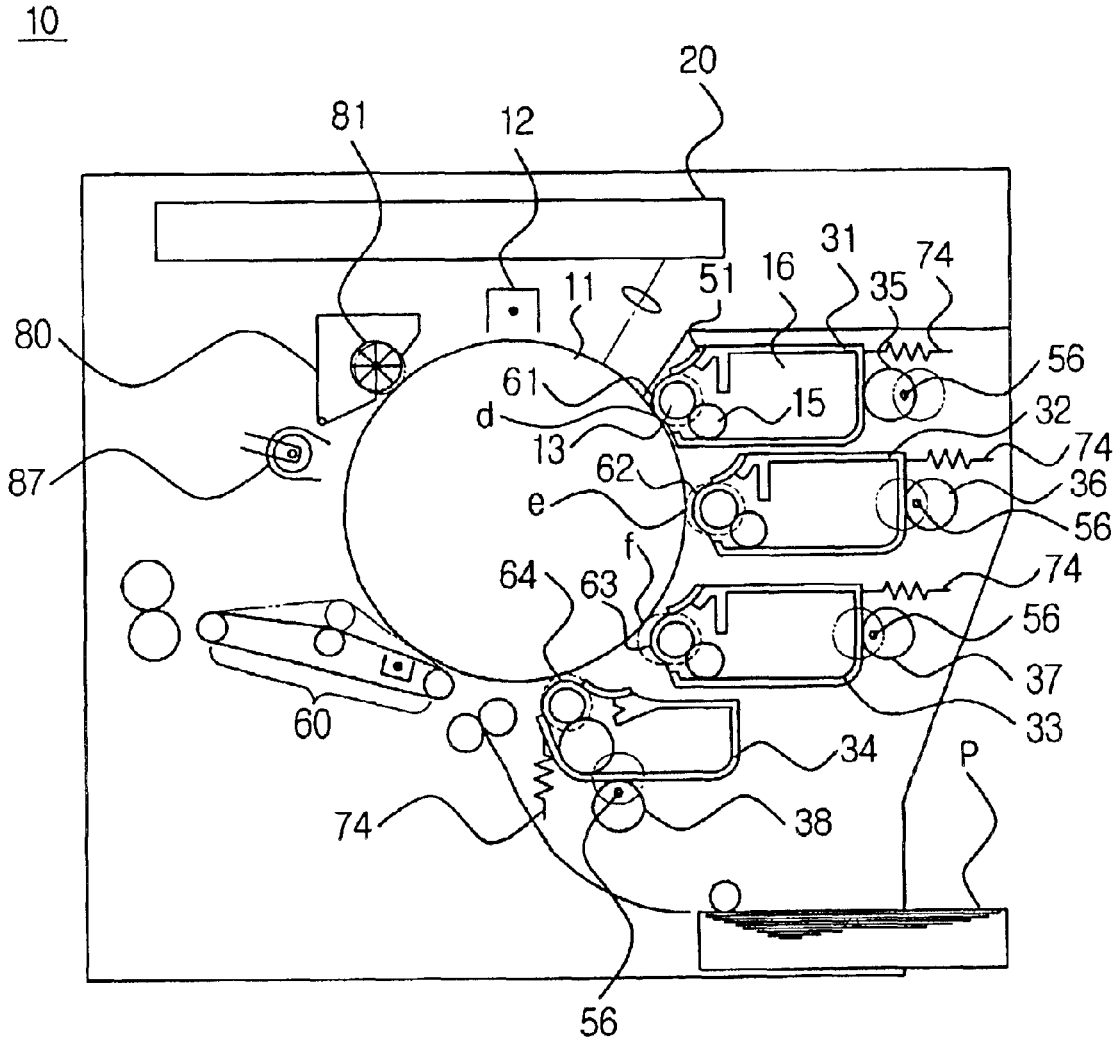
FIG. 1 (PRIOR ART)
FIG. 1 is a schematic view of a conventional image forming apparatus.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
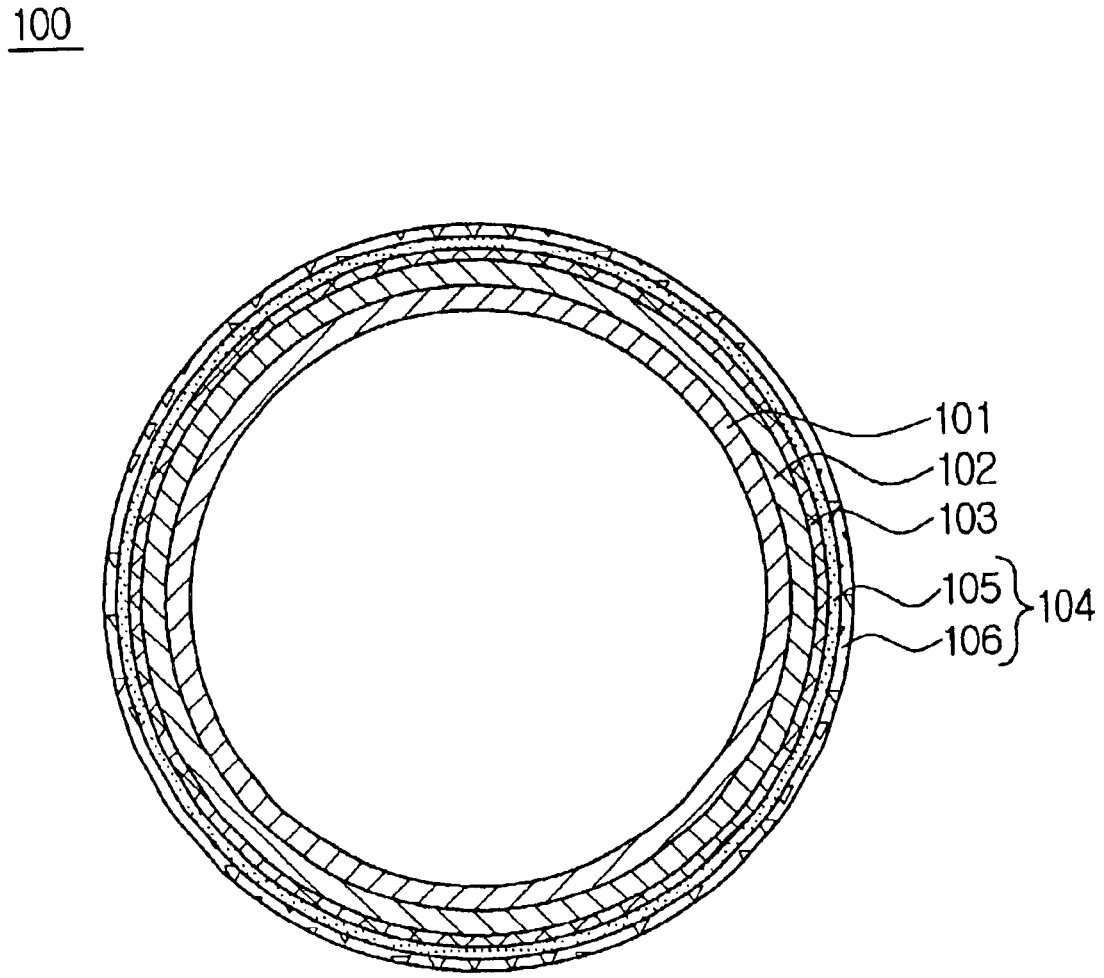
FIG. 2 is a cross-sectional view of a photoconductive drum according to an embodiment of the present invention.

Referring now to FIG. 2, there is illustrated a photoconductive drum 100 in accordance with an embodiment of the present invention, which can be used in an image forming process including charging, photo-exposure, development, and transferring operations in an image forming apparatus to print a full colored image by overlapping toners of four colors in electrophotography.

The photoconductive drum 100 includes a cylindrical base body 101 contacting an earth part (not shown) to be grounded while the photoconductive drum 100 is rotated, an elastic layer 102 having an electric conductivity formed in a given thickness on the cylindrical base body 101, an adhering layer 103 formed on the elastic layer 102, and a photosensitive layer 104 formed on the adhering layer 103.

The cylindrical base body 101 is a hollow conductive cylinder having the electric conductivity and made from one of a metal such as copper, aluminum, gold, argentum, platinum, palladium, iron, nickel, stainless steel and the like, or an alloy containing the above metal as a major ingredient; or a hollow cylinder having a film made of one of aluminum, aluminum-contained alloy, and ITO-contained alloy and coated on the above hollow conductive cylinder by a vacuum plating or evaporation (sputtering) method.

Also, the cylindrical base body 101 can be formed of a hollow plastic cylinder impregnated by fine conductive particles together with plastic having a proper binder or a conductive binder.

In this case, the hollow plastic cylinder is made by mixing a thermo-plastic resin such as a polymer selected from a group consisting of polycarbonate resin, acryl resin, styrene resin, polyolefin resin, fluoric resin, polyester resin, polyphenylene-sulfide resin, polyphthalamide resin, and liquid crystal polymer; a conductive agent made of one of carbon black, tin oxide, titamium oxide, and argentum to control an electric resistance of the fine conductive particles supplementing electric conductivity (bulk resistivity below 106 Ω·cm); and a dispersing agent made of inorganic powders such as calcium carbonate and clay, having an average grain size of below 50 $\mu$m in diameter to uniformly disperse the conductive agent, and then by injecting the resultant mixture into a mold by an injection molding process to obtain the hollow plastic cylinder having a stable surface roughness.

In the hollow plastic cylinder, there is no need for machine work, compared to the hollow cylinder, which is made from the metal such as aluminum, requiring surface grinding or cutting work for a portion thereof engaged with gears coupled to a rotation power source (not shown), since the hollow plastic cylinder is formed by the injection molding from which measurements in the portion thereof engaged with the gears can be obtained in high precision. Particularly, in a case that the hollow plastic cylinder is made of a material having a well scribed surface characteristic corresponding to the mold, there is no need for the surface grinding after forming.

Also, since the conductive agent such as carbon black is added to supplement the electric conductivity, the hollow plastic cylinder can be smoothly discharged when the hollow plastic cylinder is electrically grounded after the photoconductive drum 100 is photo-exposed and developed.

Here, although the cylindrical base body 101 is illustrated only as the hollow cylinder, it can be formed of other shapes such as a general cylinder, a cylinder having an axle therein and the like.

On an outer surface of the cylindrical base body 101, the elastic layer 102, which is made by a coating process such as dip coating, spray coating and spin coating, or an injection molding process, is disposed. The elastic layer 102 absorbs shocks generating when the photoconductive drum 100 contacts a development roller, a charging roller, and a transfer roller and impacts caused by the development roller when developing devices are exchanged or replaced. The elastic layer 102 is made of a rubber material having at least one selected from a group consisting of elastomers such as butyl rubber, fluoric rubber, acryl rubber, ethylene-propylene-diene-methylene (EPDM) rubber, acrylonitrile-butadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, polysulfide rubber, polynorbornene rubber, hydrogenated nitrile rubber and the like; and thermoplastic elastomers such as polystyrene elastomer, polyolefin elastomer, polyvinyl chloride elastomer, polyurethane elastomer, polyamide elastomer, polyurea elastomer, polyester resin, fluoric resin and the like.

In a case that the cylindrical base body 101 is formed of the metal or the metal-contained alloy, the elastic layer 102 can be made of resin having at least one selected from a group consisting of polycarbonate resin; fluoric resin such as ethylene-tetrafluoroethylene (ETFE) and polyvinylidene fluoride (PVDF); styrene resin (homopolymer or copolymer containing styrene or styrene substituent) such as polystyrene, polychlorostyrene, poly-α-methylstyrene, styrene-butadiene copolymer, styrene-vinyl chloride copolymer, styrene-vinyl acetate copolymer, styrene-maleic acid copolymer, styrene-acrylate copolymer (styrene-methyl acrylate copolymer, styrene-ethyl acrylate copolymer, styrene-butyl acrylate copolymer, styrene-octyl acrylate copolymer, styrene-phenyl acrylate copolymer and the like), styrene-ester methacrylate copolymer (styrene-methyl methacrylate copolymer, styrene-ethyl methacrylate copolymer, styrene-phenyl methacrylate copolymer and the like), styrene-methyl α-chloroacrylate copolymer, and styrene-acrylonitrile-acrylate copolymer; methyl methacrylate resin; butyl methacrylate resin; ethyl acrylate resin; butyl acrylate resin; modified acrylic resin (silicone-modified acrylic resin, vinyl chloride resin-modified acrylic resin, acrylic urethane resin and the like); vinyl chloride resin; vinyl chloride-vinyl acetate copolymer; rosin modified maleic resin; phenolic resin; epoxy resin; polyester resin; polyester-polyurethane resin; polyethylene; polypropylene; polybutadiene; polyvinylidene chloride; ionomer resin; polyurethane resin; silicone resin; ketone resin; ethylene-ethyl acrylate copolymer; xylene resin; polyvinyl butyral resin; polyamide resin; and modified polyphenylene oxide resin.

Also, the elastic layer 102 can be formed of a foam material.

Even though any material among the above described materials is used as the elastic layer 102, it is possible that it has a hardness of below 70 degrees by the Asker "C" scale to absorb the shocks generating when the photoconductive drum 100 contacts the development roller, the charging roller, and the transfer roller and the impacts exerted on the cylindrical base body 101 and the photosensitive layer 104 by the development roller and the like when the developing devices are exchanged or replaced.

Thus, the elastic layer 102 is elastically partially transformed in response to a contact pressure by the development roller and the like, so that the cylindrical base body 101 is not only prevented from receiving the shocks or impacts caused by the development roller and the like, but also tightly contacts the transfer roller and the like without exerting an excessive contact pressure thereto, thereby obtaining a stable transfer image.

Also, in the elastic layer 102, the conductive agent supplementing the electric conductivity to control the electric resistance can be added to ensure the electric charge on the surface thereof to be smoothly discharged when the cylindrical base body 101 is electrically grounded after the photoconductive drum 100 is photo-exposed and developed, i.e., after a developed toner image is transferred onto an image-transferring part or a sheet of printing paper. The conductive agent can use an electrically conductive material having at least one of carbon black, graphite, metal powder of aluminum and nickel, and conductive metal oxide such as tin oxide, titanium oxide, antimony oxide, indium oxide, potassium titanate, antimony tin oxide (ATO), and ITO. At this time, as the conductive agent, a material forming corpuscles of insulating fine particles such as barium sulfate, magnesium silicate and calcium carbonate is coated on the conductive metal oxide.

Also, when the conductive agent having a low electric resistance and a high electric conductivity, for example the carbon black having a high electric conductivity and an average grain size in the range of 20–50 nm in diameter and a bulk resistivity of 10 Ω·cm, or furnace carbon having the high electric conductivity is used, the amount of the conductive agent can not only be reduced, but also a bulk resistivity ratio of the elastic layer 102 can be satisfied.

On the elastic layer 102, the adhering layer 103 having isolation and adhesion functions is formed. The adhering layer 103 has additional functions of improving adhesion between the elastic layer 102 and the photosensitive layer 104, improving a coating ability of the photosensitive layer 104, preventing covering defects of the elastic layer 102, improving injection of the electric charge from the elastic layer 102 and the cylindrical base body 101, and protecting the photosensitive layer 104 from being electrically damaged.

The adhering layer 103 can be formed of resin or metal oxide made by chemically and electro-chemically oxidizing a surface of the elastic layer 102, but it is possible that the adhering layer 103 may be made of a material including a white pigment and a resin as a chief ingredient. In a case that the material includes the white pigment and the resin, the white pigment includes the metal oxide such as aluminum oxide, zirconium oxide, zinc oxide, and titanium oxide. The titanium oxide can effectively prevent electric charge from being injected from the elastic layer 102. Also, the resin material can include at least one selected from a group consisting of thermoplastic resin such as ethyl cellulose, polyurethane resin, polyamide resin, polyvinyl alcohol resin, casein, and methyl cellulose; and thermosetting resin such as acrylic resin, phenolic resin, melamine resin, alkyd resin, unsaturated polyester resin, epoxy resin and the like.

It is possible that a thickness of the adhering layer 103 is below 0.5 μm, more particularly in the range of 0.2–0.3 μm.

The photosensitive layer 104 formed on the adhering layer 103 includes a charge-generating layer 105 and a charge-transmitting layer 106.

The charge-generating layer 105 is made of one selected from organic pigments or dyes such as monoazo pigment, bisazo pigment, trisazo pigment, tetrakisazo pigment, triarylmethane dye, thiazine dye, oxazine dye, xanthene dye, cyanine dye, styryl dye, pyrylium dye, quinacridone pigment, indigo pigment, perylene pigment, polycyclic quinone pigment, bisbenzimidazole pigment, indanthrene pigment, squarilium pigment, phthalocyanine pigment and the like; and inorganic materials such as selenium, selenium-arsenic alloy, selenium-tellurium alloy, cadmium sulfide, zinc oxide, titanium oxide, amorphous silicon, and the like.

A solvent used in coating the charge-generating layer 105 can be selected in view of solubility or dispersing stability of binding resin and charge-generating material to be used. As an organic solvent used in coating the change-generating layer 105, alcohol, sulfoxide, ketone, ether, ester, aliphatic halogenated hydrocarbon, or aromatic compound can be used.

The charge-generating layer 105 is formed by dispersing the charge-generating material in the solvent and the binding resin of 0.3 to 4 times as much as weight of the charge-generating material using a disperser such as a homogenizer, ultrasonic disperser, ball mill, sand mill, attritor, or roll mill, and drying after applying the dispersed solution on the adhering layer 104. A thickness of the charge-generating layer 105 is preferably below 5 μm, more particularly in the range of 0.01–1 μm.

The charge-transmitting layer 106 is formed on the charge-generating layer 105 by using at least one kind of the binding resin.

A charge-transmitting material of the change-transmitting layer 106 can be formed by mixing at least one selected from a group consisting of anthrathene derivative, pyrene derivative, carbazole derivative, tetrazole derivative, metallocene derivative, phenothiazine derivative, pyrazoline compound, hydrazone compound, styryl compound, styryl hydrazone compound, enamine compound, butadiene compound, distyryl compound, oxazole compound, oxadiazole compound, thiazole compound, imidazole compound, triphenylamine derivative, phenylenediamine derivative, aminostilbene derivative, triphenylmethane derivative, and the like.

As the binding resin forming the charge-generating layer 105 and the charge-transmitting layer 106 of the photosensitive layer 104, thermoplastic resin, thermosetting resin, photo-curable resin, photoconductive resin and the like can be used.

More specifically, the binding resin may include at least one selected from a group consisting of thermoplastic resin such as polyvinyl chloride, polyvinyidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester resin, phenoxy resin, methacrylic resin, polystyrene, polycarbonate, polyarylate, polysulfone, polyethersulfone, ABS resin and the like; thermosetting resin such as phenolic resin, epoxy resin, urethane resin, melamine resin, isocyanata resin, alkyd resin, silicone resin, thermosetting acrylic resin and the like; and photoconductive resin such as polyvinyl carbazole, polyvinyl anthracene, polyvinyl pyrene and the like.

Generally, the charge-transmitting layer 106 is made by melting the charge-transmitting material and the binding resin in the solvent and then drying after coating the resultant melted solution on the charge-generating layer 105. The charge-transmitting material and the binding resin can be mixed in a weight ratio of two to one or one to two. The solvent may be acetone, ketone such as methyl ethyl ketone, ester such as methyl acetate and ethyl acetate, aromatic hydrocarbon such as toluene and xylene, and hydrocarbon chloride such as chlorobenzene, chloroform and carbon tetrachlororide. A thickness of the charge-transmitting layer 106 is preferably in the range of 5–40 $\mu$m, more particularly in the range of 10–30 $\mu$m.

To form the charge-generating layer 105 and the charge-transmitting layer 106 as described above, when the solution is coated, the coating process, such as dip coating, spray coating and spin coating processes can be used. The drying is performed at a temperature of 10–200° C., preferably 20–150° C. for 5–300 minutes, preferably 10–120 minutes under airing or natural seasoning (drying) condition.

The charge-generating layer 105 or the charge-transmitting layer 106 may contain annexes, such as an antioxidant, ultraviolet absorbent, and lubricant.

As explained above, since the surface of the photoconductive drum 100 has elasticity, various rotatable bodies, which are rotated while pressure-contacting the photoconductive drum 100, for example, a contact type charging roller, a contact type development roller, and/or a contact type transfer roller or drum, can be made of a rigid body instead of an elastic body.

Figure 3:
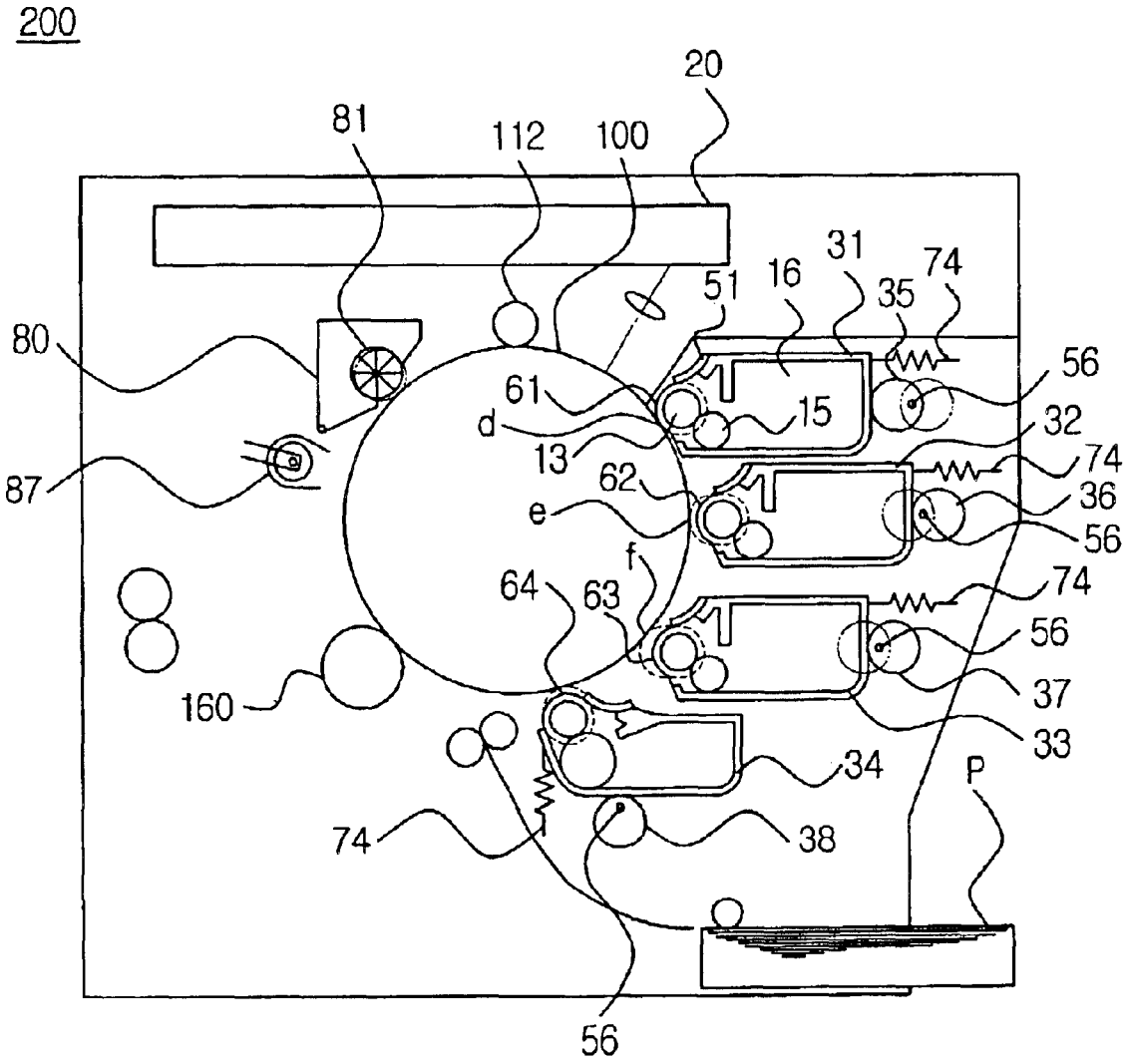
FIG. 3 is a schematic view of an image forming apparatus having the photoconductive drum of FIG. 2.

Referring now to FIG. 3, there is illustrated a schematic view of an image forming apparatus 200 having the photoconductive drum 100 in accordance with the embodiment of the present invention.

The image forming apparatus 200 has the same structure as that of the conventional image forming apparatus 10 shown in FIG. 1 except the photoconductive drum 100, a charging roller 112 made of a rigid body, and an image-transferring part having a transfer roller 160 made of a rigid body. The charging roller 112 electrifies the photoconductive drum 100 and rotating while contacting a surface of the photoconductive drum 100. The image-transferring part having the transfer roller 160 transfers a toner image of four colors formed on the surface of the photoconductive drum 100 onto the printing paper P fed from a paper-storing cassette while pressure-contacting the surface of the photoconductive drum 100.

Accordingly, even though the image forming apparatus 200 uses the development roller 13 made of a rigid body, the charging roller 112 of the rigid body, and the transfer roller 160 of the rigid body, problems, such as deterioration in an image quality and shortening a life span of the photoconductive drum 100, caused by the contact shocks generating when the photoconductive drum 100 contacts the development roller 13, the charging roller 112, and the transfer roller 160 and the impacts caused by the development roller 13 when the developing devices 31, 32, 33, 34 are exchanged or replaced, do not occur.

As apparent from the foregoing description, it can be appreciated that the photoconductive drum and the image forming apparatus in accordance with the embodiment of the present invention have an effect of absorbing the shocks generating when the photoconductive drum contacts the development roller, the charging roller, and the transfer roller and the impacts caused by the development roller when the developing devices are exchanged or replaced, to protect the cylindrical base body of the photoconductive drum and the photosensitive layer thereon, thereby to maintain the stable image quality and to extend the life span of the photoconductive drum, even though the development roller and the charging roller or the transfer roller are rigid bodies.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A photoconductive drum forming an image by using an electric potential characteristic of a surface thereof in an image forming apparatus, comprising:

a cylindrical member;

a photosensitive layer formed on the cylindrical member to be chargeable with electricity;

an elastic layer formed in a thickness greater than 10 $\mu$m between the cylindrical member and the photosensitive layer; and an adhering layer formed on the elastic layer.

2. The photoconductive drum according to claim 1, wherein the elastic layer has a hardness of below 70 degrees in Asker "C" scale.

3. The photoconductive drum according to claim 2, wherein the cylindrical member is made of a conductive material including one of a metal consisting of at least one selected from a group consisting of copper, aluminum, gold, argentum, platinum, palladium, iron, nickel, and stainless steel, and an alloy containing the metal as a major ingredient, and the cylindrical member comprises a film made of a material including one of aluminum, aluminum-contained alloy, and indium tin oxide (ITO)-contained alloy and formed on the conductive material.

4. The photoconductive drum according to claim 2, wherein the elastic layer comprises a material at least one selected from a group comprising:

elastomers consisting of at least one selected from a group consisting of butyl rubber, fluoric rubber, acryl rubber, ethylene-propylene-diene-methylene (EPDM) rubber, acrylonitrile-butadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, polysulfide rubber, polynorbornene rubber, and hydrogenated nitrite rubber, and thermoplastic elastomers consisting of at least one selected from a group consisting of polystyrene elastomer, polyolefin elastomer, polyvinyl chloride elastomer, polyurethane elastomer, polyamide elastomer, polyurea elastomer, polyester resin, and fluoric resin.

5. The photoconductive drum according to claim 2, wherein the elastic layer comprises a resin material having at least one selected from a group consisting of:

polycarbonate resin; a fluoric resin having at least one of the ethylene-tetrafluoroethylene (ETFE) and polyvinylidene fluoride (PVDF); styrene resin of homopolymer or copolymer containing styrene or styrene substituent consisting of at least one selected from a group consisting of polystyrene, polychlorostyrene, poly-α-methylstyrene, styrene-butadiene copolymer, styrene-vinyl chloride copolymer, styrene-vinyl acetate copolymer, styrene-maleic acid copolymer, styrene-acrylate copolymer, styrene-ester methaclylate copolymer, styrene-methyl α-chloroacrylate copolymer, and styrene-acrylonitrile-acrylate copolymer methyl methacrylate resin; butyl methacrylate resin; ethyl acrylate resin; butyl acrylate resin; modified acrylic resin; vinyl chloride resin; vinyl chloride-vinyl acetate copolymer; rosin modified maleic resin; phenolic resin; epoxy resin; polyester resin; polyester-polyurethane resin; polyethylene; polypropylene; polybutadiene; polyvinylidene chloride; ionomer resin; polyurethane resin; silicone resin; ketone resin; ethylene-ethyl acrylate copolymer; xylene resin; polyvinyl butyral resin; polyamide resin; and modified polyphenylene oxide resin.

6. The photoconductive drum according to claim 2, wherein the elastic layer is formed of a foam material.

7. The photoconductive drum according to claim 2, wherein the elastic layer comprises:

a conductive agent controlling an electric charge on a surface thereof to be discharged when the photoconductive drum is electrically grounded.

8. The photoconductive drum according to claim 7, wherein the conductive agent comprises one of:

an electrically conductive material having at least one selected from a group consisting of carbon black, graphite, powder of metal such as aluminum and nickel, and conductive metal oxide such as tin oxide, titanium oxide, antimony oxide, indium oxide, potassium titanate, antimony tin oxide (ATO), and indium tin oxide (ITO); and a material having one of barium sulfate, magnesium silicate and calcium carbonate to form corpuscles and coated on the electrically conductive material.

9. The photoconductive drum according to claim 2, wherein the adhering layer is formed between the elastic layer and the photosensitive layer.

10. The photoconductive drum according to claim 9, wherein the adhering layer comprises a white pigment and a resin material.

11. The photoconductive drum according to claim 10, wherein the white pigment comprises a metal oxide having at least one selected from a group consisting of titanium oxide, aluminum oxide, zirconium oxide, and zinc oxide; and the resin material comprises:

a thermoplastic resin compound having at least one selected from a group consisting of ethyl cellulose, polyurethane resin, polyamide resin, polyvinyl alcohol resin, casein, and methyl cellulose; and thermosetting resins such as acrylic resin, phenolic resin, melamine resin, alkyd resin, unsaturated polyester resin and epoxy resin.

12. The photoconductive drum according to claim 2, wherein the cylindrical member comprises a plastic material impregnated by fine conductive particles together with a conductive binder.

13. The photoconductive drum according to claim 12, wherein the plastic material comprises:

a thermo-plastic resin having at least one selected from a group consisting of polycarbonate resin, acryl resin, styrene resin, polyolefin resin, fluoric resin, polyester resin, polyphenylene-sulfide resin, polyphthalamide resin, and liquid crystal polymer;

a conductive agent controlling an electric resistance of the cylindrical member and made of a conductive material having at least one selected from a second group consisting of carbon black, tin oxide, titanium oxide, and argentum; and a dispersing agent uniformly dispersing the conductive agent within the cylindrical member and made of an inorganic matter having one of calcium carbonate and clay.

14. The photoconductive drum according to claim 12, wherein the elastic layer comprises a material at least one selected from a group consisting of:

elastomers consisting of at least one selected from a group consisting of butyl rubber, fluoric rubber, acryl rubber, ethylene-propylene-diene-methylene (EPDM) rubber, acrylonitrile-butadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulforlated polyethylene, chlorinated polyethylene, urethane rubber, syndiotactic 1,2-polybutadiene, epichlorohydrin rubber, silicone rubber, polysulfide rubber, polynorbornene rubber, and hydrogenated nitrile rubber; and thermoplastic elastomers consisting of at least one selected from a group consisting of polystyrene elastomer, polyolefin elastomer, polyvinyl chloride elastomer, polyurethane elastomer, polyamide elastomer, polyurea elastomer, polyester resin, and fluoric resin.

15. The photoconductive drum according to claim 12, wherein the elastic layer is formed of a foam material.

16. The photoconductive drum according to claim 12, wherein the elastic layer comprises:

a conductive agent controlling an electric charge on a surface thereof to be discharged when the photoconductive drum is electrically grounded.

17. The photoconductive drum according to claim 16, wherein the conductive agent comprises one of:

an electrically conductive material consisting of at least one selected from a group consisting of carbon black, graphite, powder of metal such as aluminum and nickel, and conductive metal oxide such as tin oxide, titanium oxide, antimony oxide, indium oxide, potassium titanate, antimony tin oxide (ATO), and indium tin oxide (ITO); and a material having at least one of barium sulfate, magnesium silicate and calcium carbonate to form corpuscles and coated on the electrically conductive material.

18. The photoconductive drum according to claim 12, wherein the adhering layer is formed between the elastic layer and the photosensitive layer.

19. The photoconductive drum according to claim 18, wherein the adhering layer comprises a white pigment and a resin material.

20. The photoconductive drum according to claim 19, wherein the white pigment comprises a metal oxide having at least one selected from a group consisting of titanium oxide, aluminum oxide, zirconium oxide, and zinc oxide; and wherein the resin material comprises:

a thermoplastic resin compound having at least one selected from a second group consisting of ethyl cellulose, polyurethane resin, polyamide resin, polyvinyl alcohol resin, casein, and methyl cellulose; and thermosetting resins such as acrylic resin, phenolic resin, melamine resin, alkyd resin, unsaturated polyester resin and epoxy resin.

21. An image forming apparatus comprising:

a photoconductive drum forming an image by using an electric potential characteristic of a surface thereof, having a cylindrical member, a photosensitive layer formed on the cylindrical member to be chargeable with electricity, an elastic layer formed in a thickness greater than 10 $\mu$m between the cylindrical member and the photosensitive layer and an adhering layer formed on the elastic layer;

a charging roller electrifying the photoconductive drum while pressure-contacting the photoconductive drum and having a rigid body; and an image forming part forming a visual image on the photoconductive drum while pressure-contacting the photoconductive drum, having a development roller made of a rigid body.

22. The image forming apparatus according to claim 21, wherein the elastic layer has a hardness of below 70 degrees in Asker "C" scale.

23. The image forming apparatus according to claim 22, further comprising:

an image transferring part comprising at least a transfer roller made of a rigid body.

24. A photoconductive drum forming an image in an image forming apparatus, comprising:

a cylindrical member;

an elastic layer formed on the cylindrical member and having a material different from that of the cylindrical member;

a photosensitive layer formed on the elastic layer and being chargeable with electricity; and an adhering layer formed on the elastic layer.

25. The photoconductive drum according to claim 24, wherein the elastic layer has a thickness being greater than 10 $\mu$m.

26. The photoconductive drum according to claim 24, wherein the cylindrical member is one of a conductive cylinder, a plastic cylinder, a hollow conductive cylinder, and a hollow plastic cylinder.

27. The photoconductive drum according to claim 24, wherein the cylindrical member comprises a conductive cylinder having a mixture of thermo-plastic resin, a conductive agent controlling an electric resistance of the cylindrical member, and a dispersing agent made of an inorganic powers and dispersing the conductive agent within the cylindrical member.

28. The photoconductive drum according to claim 24, wherein the cylindrical member comprises a layer made of one of a conductive material and an alloy containing the conductive material.

29. The photoconductive drum according to claim 25, wherein the cylindrical member comprises a second layer formed on the layer and made of one of aluminum, aluminum-contained alloy, and indium tin oxide (ITO)-contained alloy.

30. The photoconductive drum according to claim 25, wherein the layer of the cylindrical member is made of one of a metal selected from of a group consisting of copper, aluminum, gold, argentum, platinum, palladium, iron, nickel, and stainless steel, and an alloy containing the metal as a major ingredient.

31. The photoconductive drum according to claim 25, wherein the elastic layer is made of a rubber material.

32. The photoconductive drum according to claim 31, wherein the rubber material comprises one of an elastomer and a thermoplastic elastomer.

33. The photoconductive drum according to claim 31, wherein the elastic layer comprises a conductive agent made of electrically conductive material to control an electric resistance of the elastic layer.

34. The photoconductive drum according to claim 32, wherein the conductive agent comprises carbon black having a diameter of 20–50 nm and a bulk resistance of 10 Ωm.

35. The photoconductive drum according to claim 33, wherein the conductive agent comprises a furnace carbon having an electric conductivity.

36. The photoconductive drum according to claim 24, wherein the adhering layer is formed between the elastic layer and the photosensitive layer.

37. The photoconductive drum according to claim 36, wherein the adhering layer covers a defect of the elastic layer and protects the photosensitive layer from being electrically damaged.

38. The photoconductive drum according to claim 36, wherein the adhering layer is made of one of resin and metal oxide.

39. The photoconductive drum according to claim 36, wherein the elastic layer comprises a surface chemically or electro-chemically oxidized to form the adhering layer.

40. The photoconductive drum according to claim 36, wherein the adhering layer has a thickness of below 0.5 $\mu$m.

41. The photoconductive drum according to claim 36, wherein the photosensitive layer comprises a charge-generation layer formed on the adhering layer and a charge-transmitting layer formed on the charge-generation layer.

42. The photoconductive drum according to claim 41, wherein the charge-generation layer is made of one of an organic pigment and dyes.

43. The photoconductive drum according to claim 41, wherein the charge-generation layer is made of an organic solvent, a charge-generating material dispersed in the organic solvent, and a binding resin mixed with the charge-generating material with a predetermined ratio between 0.4 and 4.

44. The photoconductive drum according to claim 41, wherein the charge-generation layer has a thickness between 0.01 and 1 $\mu$m inclusive.

45. The photoconductive drum according to claim 41, wherein the charge-transmitting layer has a thickness between 10 and 30 $\mu$m inclusive.

46. The photoconductive drum according to claim 41, wherein the charge-transmitting layer comprises a charge-transmitting material and a binding resin mixed with the charge-transmitting material with a predetermined weight ratio between 1:2 and 2:1.

47. A method of forming a photoconductive drum in an image forming apparatus comprising:

forming a cylindrical member made of one of a conductive cylinder, a plastic cylinder, a hollow conductive cylinder, and a hollow plastic cylinder;

forming an elastic layer made of a rubber material on the cylindrical member;

forming an adhering layer made of one of resin and metal oxide on the elastic layer; and forming a photosensitive layer formed on the adhering layer.

* * * * *

UNITED STATES PATENT AND TRADEMARK OFFICE

CERTIFICATE OF CORRECTION

PATENT NO. : 6,815,134 B2
DATED : November 9, 2004
INVENTOR(S) : Myung-ho Kyung

It is certified that error appears in the above-identified patent and that said Letters Patent is hereby corrected as shown below:

Column 12,
Line 51, change “nitrite” to -- nitrile --;
Line 63, delete “the”

Column 13,
Line 5, change “methaclylate” to -- methacrylate --;
Line 8, after “copolymer” delete “;”;

Column 14,
Line 20, change “chlorosulforlated” to -- chlorosulfonated --;

Column 15,
Line 24, change “image transferring” to -- image-transferring --; and Column 16,
Line 54, after “apparatus” insert -- , --.

Signed and Sealed this

Twenty-fourth Day of May, 2005

JON W. DUDAS
*Director of the United States Patent and Trademark Office*